US011024940B2

(12) United States Patent
Sayama

(10) Patent No.: US 11,024,940 B2
(45) Date of Patent: Jun. 1, 2021

(54) VEHICLE ANTENNA AND WINDOW GLASS FOR VEHICLE

(71) Applicant: AGC Inc., Tokyo (JP)

(72) Inventor: Toshiki Sayama, Tokyo (JP)

(73) Assignee: AGC INC., Tokyo (JP)

( * ) Notice: Subject to any disclaimer, the term of this patent is extended or adjusted under 35 U.S.C. 154(b) by 0 days.

(21) Appl. No.: 16/591,861

(22) Filed: Oct. 3, 2019

(65) Prior Publication Data

US 2020/0036078 A1 Jan. 30, 2020

Related U.S. Application Data

(63) Continuation of application No. PCT/JP2018/016352, filed on Apr. 20, 2018.

(30) Foreign Application Priority Data

Apr. 24, 2017 (JP) ..... JP2017-085478

(51) Int. Cl.
*H01Q 1/32* (2006.01)
*H01Q 1/12* (2006.01)

(52) U.S. Cl.
CPC ..... *H01Q 1/1271* (2013.01); *H01Q 1/325* (2013.01)

(58) Field of Classification Search
CPC ..... H01Q 1/1271; H01Q 1/32
See application file for complete search history.

(56) References Cited

U.S. PATENT DOCUMENTS 3,771,159 A * 11/1973 Kawaguchi ..... H01Q 1/1271 343/729
6,225,954 B1 5/2001 Edvardsson et al.
9,350,071 B2 * 5/2016 Kobayashi ..... H01Q 1/325
10,651,535 B2 * 5/2020 Niwano ..... H01Q 1/1271
2006/0097935 A1 5/2006 Colburn et al.
(Continued)

FOREIGN PATENT DOCUMENTS

WO WO-2016/052709 A1 4/2016
WO WO-2016/125876 A1 8/2016

OTHER PUBLICATIONS

International Searching Authority, "International Search Report," issued in connection with International Patent Application No. PCT/JP2018/016352, dated Jul. 10, 2018.
(Continued)

*Primary Examiner* — Hasan Z Islam
(74) *Attorney, Agent, or Firm* — Foley & Lardner LLP

(57) ABSTRACT

A vehicle antenna arranged on a window glass for vehicle includes an element portion having a shape of a crank and being formed by a first element, a second element and a third element; and a feeding portion configured to feed power to the element portion. The first element has a first upper end portion and a first lower end portion, and extends in an up-down direction of the window glass. The second element has a second upper end portion and a second lower end portion, and extends in the up-down direction of the window glass. The third element extends between the first lower end portion and the second upper end portion. A first distance between the first lower end portion and the window glass is different from a second distance between the second upper end portion and the window glass.

20 Claims, 9 Drawing Sheets

(56) References Cited

U.S. PATENT DOCUMENTS

| | | | | |
|---|---|---|---|---|
| 2016/0294037 | A1* | 10/2016 | Ochi | H01Q 9/42 |
| 2017/0187090 | A1 | 6/2017 | Niwano et al. | |
| 2017/0301981 | A1 | 10/2017 | Niihara et al. | |

OTHER PUBLICATIONS

International Searching Authority, "Written Opinion," issued in connection with International Patent Application No. PCT/JP2018/016352, dated Jul. 10, 2018.

* cited by examiner

VEHICLE ANTENNA AND WINDOW GLASS FOR VEHICLE

CROSS-REFERENCE TO RELATED APPLICATION

The present application is a continuation application filed under 35 U.S.C. 111(a) claiming benefit under 35 U.S.C. 120 and 365(c) of PCT International Application No. PCT/JP2018/016352 filed on Apr. 20, 2018 and designating the U.S., which claims priority of Japanese Patent Application No. 2017-085478 filed on Apr. 24, 2017. The entire contents of the foregoing applications are incorporated herein by reference.

BACKGROUND OF THE INVENTION

1. Field of the Invention

The disclosure herein generally relates to a vehicle antenna and a window glass for vehicle.

2. Description of the Related Art

In the related art, L-shaped vehicle antennas, U-shaped vehicle antennas (including J-shaped vehicle antennas) have been known (See, for example, WO 2016/052709).

SUMMARY OF THE INVENTION

Technical Problem

A telematics service that transmits information between a communication device installed in a vehicle and a vehicle outside has been known. In a vehicle antenna used in the telematics service, in order to accommodate a vertically polarized electromagnetic wave that propagates in a direction parallel to the horizontal plane (i.e. horizontal direction), a directivity of the antenna in the horizontal direction is desired to be enhanced.

Moreover, a wireless communication used in the Intelligent Transport Systems (ITS), includes, for example, a Dedicated Short Range Communication (DSRC). The DSRC is used for a road-vehicle communication, a vehicle-to vehicle communication, or the like. In a vehicle antenna used in the ITS, such as the DSRC, a directivity of the antenna in the horizontal direction is desired to be enhanced, taking into account the positional relationship between the own vehicle and the communication partner.

With an L-shaped antenna or a U-shaped antenna, as in the related art, the directivity in the horizontal direction is enhanced. However, because the L-shaped antenna greatly protrudes from a vehicle interior surface of the window glass for vehicle, it is difficult to reduce the height of the antenna. In the U-shaped antenna, an impedance matching deteriorates easily.

Thus, the disclosure of the present application provides a vehicle antenna and a window glass for vehicle, in which a directivity in the horizontal direction is enhanced, the height of the antenna is reduced, and an excellent impedance matching is maintained.

Solution to Problem

According to an aspect of the disclosure of the present application, a vehicle antenna arranged on a window glass for vehicle including an element portion having a shape of a crank and being famed by a first element, a second element and a third element; and a feeding portion configured to feed power to the element portion, the first element having a first upper end portion and a first lower end portion, and extending in an up-down direction of the window glass, the second element having a second upper end portion and a second lower end portion, and extending in the up-down direction of the window glass, the third element extending between the first lower end portion and the second upper end portion, and a first distance between the first lower end portion and the window glass being different from a second distance between the second upper end portion and the window glass, is provided.

According to another aspect of the disclosure of the present application, a window glass for vehicle provided with the vehicle antenna is provided.

Effect of Invention

According to an aspect of the present invention, the directivity in the horizontal direction is enhanced, the height of the antenna is reduced, and an excellent impedance matching is obtained.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

Figure 1:
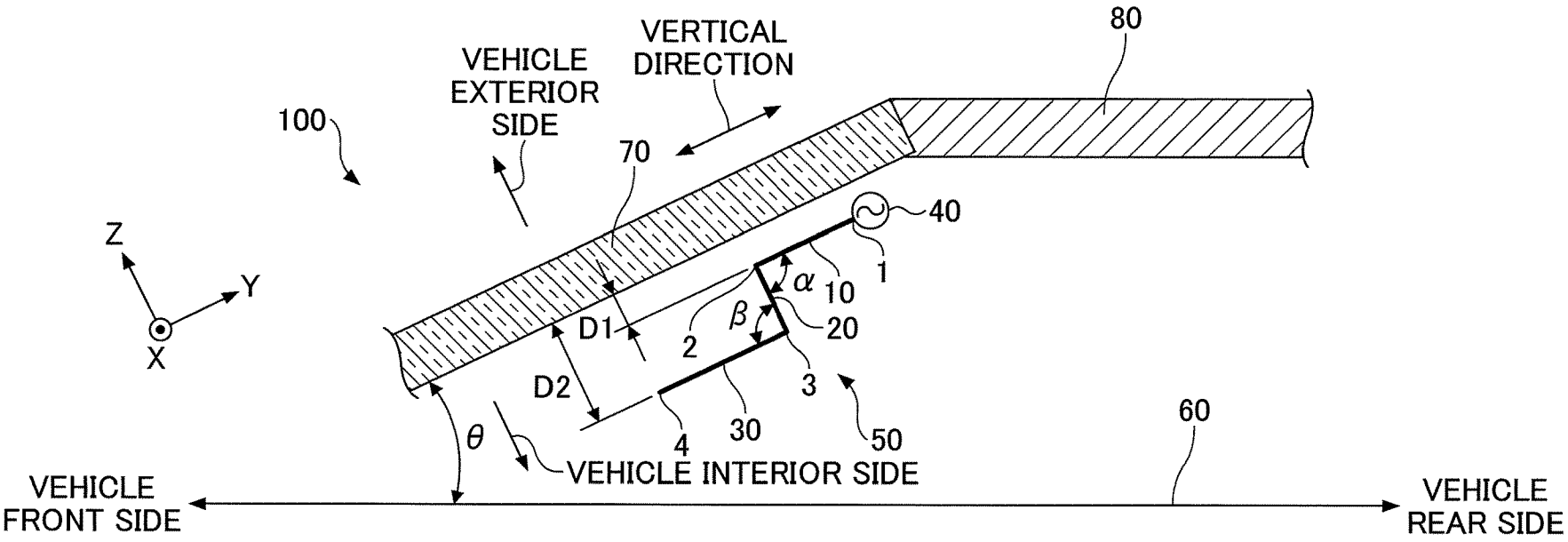
FIG. 1 is a cross-sectional view schematically depicting an example of a configuration of a vehicle antenna and a window glass for vehicle according to an embodiment.

In the following, an embodiment of the present invention will be described with reference to the accompanying drawings. In the drawings for describing the embodiment, in the absence of a specific description with respect to a direction, the direction refers to a direction indicated in the drawings. Reference directions in the respective drawings correspond to directions of symbols or numerals. Moreover, a direction, such as parallel, orthogonal or the like allows for deviations so long as the effects of the present invention are maintained. Moreover, a window glass, to which the present invention can be applied, includes, for example, a windshield (front glass) arranged in a front part of a vehicle. The window glass may be a rear windshield arranged in a rear part of the vehicle, or a side windshield arranged in a side part of the vehicle.

FIG. 1 is a cross-sectional view schematically depicting an example of a configuration of a vehicle antenna and a window glass for vehicle according to an embodiment, and indicates a cross-section in a plane orthogonal to a vehicle width direction. In the following description of the embodiment, a Y-axis direction indicates an up-down direction of a window glass 70. A Z-axis direction indicates a direction orthogonal to a surface of the window glass 70. An X-axis direction indicates a vehicle width direction of a vehicle 80. A left part of FIG. 1 indicates a vehicle front, and a right part of FIG. 1 indicates a vehicle rear.

An antenna 100, shown in FIG. 1, is an example of a vehicle antenna arranged on a window glass for vehicle. The antenna 100 is mounted to the window glass 70 via a mounting member (not shown). The window glass 70 is an example of a window glass on which a vehicle antenna is arranged. FIG. 1 shows the window glass 70 that is a windshield (front glass). The window glass 70 is mounted to a window frame of the vehicle 80 at an angle θ with respect to a horizontal plane 60. The angle θ is greater than 0° and less than 90° (e.g. 30°).

The antenna 100 includes an element portion 50 having a shape, in cross-section (in side view), of a crank (as in a crank handle), and being famed by an element 10, an element 20, and an element 30; and a feeding portion 40 that feeds power to the element portion 50.

The element 10 is an example of a first element, and is a conductor extending in the up-down direction of the window glass 70. The element 10 is a rectangular shaped conductor formed so as to face a vehicle interior side surface of the window glass 70. The element 10 extends from an upper side edge toward a lower side edge. The element 10 has an upper end portion 1 and a lower end portion 2 in the up-down direction of the window glass 70. The upper end portion 1 is an example of a first upper end portion. The lower end portion 2 is an example of a first lower end portion. The upper end portion 1 indicates an upper edge of the element 10 and a periphery of the upper edge. The lower end portion 2 indicates a lower edge of the element 10 and a periphery of the lower edge. A shape of the element 10 and shapes of the other elements, which will be described later, are not limited to rectangular, and the shapes may be other shapes.

The element 30 is an example of a second element, and is a conductor extending in the up-down direction of the window glass 70. The element 30 is a rectangular shaped conductor formed so as to face the vehicle interior side surface of the window glass 70. The element 30 extends from the upper side edge toward the lower side edge. The element 30 has an upper end portion 3 and a lower end portion 4 in the up-down direction of the window glass 70. The upper end portion 3 is an example of a second upper end portion. The lower end portion 4 is an example of a second lower end portion. The upper end portion 3 indicates an upper edge of the element 30 and a periphery of the upper edge. The lower end portion 4 indicates a lower edge of the element 30 and a periphery of the lower edge.

The element 20 is an example of a third element, and is a conductor extending between the lower end portion 2 and the upper end portion 3. One end of the element 20 is connected to the lower end portion 2 and another end of the element 20 is connected to the upper end portion 3.

A distance D1 indicates a distance between the lower end portion 2 and the vehicle interior side surface of the window glass 70 (an example of a first distance). A distance D2 indicates a distance between the upper end portion 3 and the vehicle interior side surface of the window glass 70 (an example of a second distance). Because the distance D1 is different from the distance D2, the antenna 100 having a three-dimensional structure with the element 20 extending in the Z-axis direction is formed.

A directivity of an antenna having a planar structure without a part extending in the Z-axis direction is liable to be greater in the normal direction to the surface of the window glass 70. The antenna 100 according to the embodiment includes the element 20 extending in the Z-axis direction, and a directivity of the antenna 100 according to the embodiment becomes greater in a direction that approaches the horizontal surface with respect to the normal direction to the surface of the window glass 70. Thus, with the antenna 100 according to the embodiment, a directivity in a direction parallel to the horizontal surface 60 (i.e. horizontal direction) is enhanced, and an antenna gain (actual gain) in the horizontal direction is increased.

Moreover, the antenna 100 according to the embodiment is provided with the element portion 50 having a shape of a crank. Compared with an L-shaped antenna having the same antenna length as the antenna 100, the height of the element portion 50 having the shape of a crank in the antenna 100, bent at two points, is easily made lower than the L-shaped antenna, bent at one point. The height of an element portion in the L-shaped antenna is a sum of a length of the element 20 and a length of the element 30. The L-shaped antenna greatly protrudes from the vehicle interior surface of the window glass 70, and forms an obstacle for a driver. In the antenna 100 according to the embodiment having the element portion 50 with a shape of a crank, a height of the element portion 50 (difference between the distances D2 and D1) is easily made smaller.

The length of the Z-axis direction component of the element 20 (the length component that is normal to the surface of the window glass 70, the actual length of the element 20 being taken as the hypotenuse) is preferably small from the viewpoint of decreasing the height of the antenna. Moreover, the length of the Z-axis direction component of the element is preferably determined according to frequencies of electromagnetic waves that are transmitted or received by the antenna. For example, the length of the Z-axis direction component of the element 20 may be 30 mm or less from the viewpoint of decreasing the height of the antenna, is preferably 23 mm or less, and is more preferably 15 mm or less. When the length of the element 20 in the Z-axis direction component is extremely small, the configuration of the antenna becomes close to that of the planar antenna without the Z-axis direction component. Thus, the length of the Z-axis direction component of the element 20 may be 4 mm or more, is preferably 7 mm or more, and is more preferably 10 mm or more. The length of the element 20 in the Z-axis direction corresponds to the height of the element 20, when both the bending angles α and β, that form the antenna in the shape of a crank are 90°.

When the frequency used for LTE is, for example, 0.96 GHz, the length of the Z-axis direction component of the element 20, normalized by a wavelength λ of electromagnetic waves at an operation frequency of the antenna, may be 0.096λ or less, is preferably 0.074λ or less, and is more preferably 0.048λ or less. In this case, the length of the Z-axis direction component of the element 20 may be 0.013λ or more, is preferably 0.022λ or more, and more preferably 0.032λ or more.

In a U-shaped antenna, a capacitive coupling between elements facing each other is liable to increase. Thus, an impedance matching easily degrades. However, in the element portion 50 according to the embodiment, the lower end portion 2 of the element 10 is connected to the upper end portion 3 of the element 30 via the element 20. Because the lower end portion 2 of the element 10 is connected to the upper end portion 3 of the element 30, the element 10 and the element 30 do not face each other, or the areas of the conductor portions of the elements 10 and 30 that face each other are small (narrow). Thus, the capacitive coupling between the element 10 and the element 30 is less likely to increase. According to the antenna 100 of the embodiment, compared with the U-shaped antenna, more excellent impedance matching is obtained.

From a viewpoint of enhancing the directivity of the antenna in the horizontal direction, as illustrated in FIG. 1, the distance D1 is preferably less than the distance D2. The distance D1 may be zero. When the distance D1 is zero, the element 10 is brought into contact with the vehicle interior side surface of the window glass 70.

Even for an antenna provided with an element portion having a shape of a crank, in which the distance D2 is less than the distance D1, a height is reduced, and an excellent impedance matching is obtained. In the antenna provided with the element portion having the shape of a crank, in which the distance D2 is less than the distance D1, the element 30 is closer to the window glass 70 than the element 10.

In order to enhance a gain of vertically polarized waves, as illustrated in FIG. 1, the element portion 50 having a shape of a crank is preferably formed so that the long-side direction of the element portion 50 is parallel to the up-down direction of the window glass 70 (i.e. the short-side direction of the element portion 50 is parallel to the vehicle width direction). In addition, the element portion 50 may be famed so that the short-side direction of the element portion 50 is parallel to the up-down direction of the window glass 70 (i.e. the long-side direction of the element portion 50 is parallel to the vehicle width direction).

A feeding portion 40 is located at the upper end portion 1. Thus, a feeding cable arranged from a roof side of the vehicle 80 is easily connected to the feeding portion 40, and the length of the feeding cable is reduced.

The element portion 50 may function as a dipole antenna by arranging the feeding portion 40 on the element 20. That is, with the element 10 and the element 30 being separated from each other by the feeding portion 40, one of the element 10 and the element 30 is connected to a core wire of a coaxial cable, and another one of the element 10 and the element 30 is connected to a ground wire of the coaxial cable. In order to adjust the input impedance, the position of the feeding portion 40 may be offset.

In the embodiment shown in FIG. 1, the antenna 100 is arranged in an upper part on the vehicle interior side of the window glass 70 so that the element 10 and the element 30 are parallel to the vehicle interior side surface of the window glass 70. Moreover, the angle α indicates an angle formed by the element 10 and the element 20, and the angle β indicates an angle formed by the element 20 and the element 30. The angle α is greater than 0° and less than 180° (e.g. 90°), and the angle β is greater than 0° and less than 180° (e.g. 90°).

The arrangement positions of the element 10 and the element 30 are not limited to the above-described positions, i.e. with respect to the element 10 and the element 30 being arranged so as to be parallel to the vehicle interior side surface of the window glass 70, respectively. The element 10 and the element 30 may be arranged so that the element 10 and the element 30 are not parallel to the surface. The angle α may be the same as the angle β, and may be different from the angle β.

The antenna 100 according to the embodiment is suitable for transmitting and receiving electromagnetic waves of the UHF (Ultra High Frequency) band. For example, the antenna 100 is suitable for transmitting and receiving electromagnetic waves of three frequency bands (0.698 GHz to 0.96 GHz, 1.71 GHz to 2.17 GHz, and 2.4 GHz to 2.69 GHz) among the plurality of frequency bands used for LTE (Long Term Evolution) communication.

Furthermore, the antenna 100 is also suitable for transmitting and receiving electromagnetic waves of the ISM (Industry Science Medical) band. The ISM band includes the communication bands of 0.863 GHz to 0.870 GHz (Europe), 0.902 GHz to 0.928 GHz (US), and 2.4 GHz to 2.5 GHz (worldwide). A communication standard using the 2.4 GHz band, one of the ISM bands, includes a wireless LAN (Local Area Network) of DSSS (Direct Sequence Spread Spectrum) system, conforming to the IEEE 802.11b; Bluetooth (trademark registered); a part of the FWA (Fixed Wireless Access) system; and the like. The electromagnetic waves the antenna 100 transmits and receives are not limited to the above-described frequency bands.

First Practical Example

Figure 2:
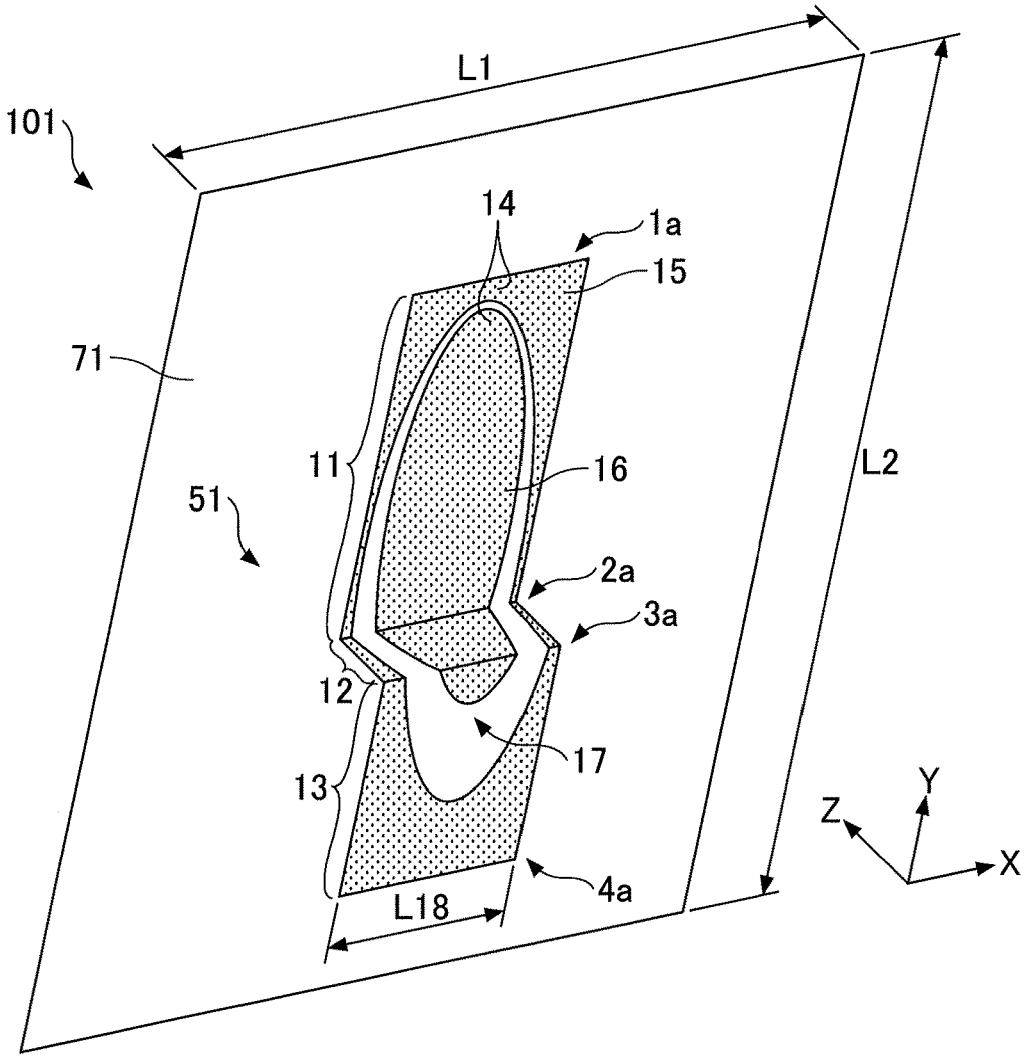
FIG. 2 is a perspective view schematically depicting a configuration of a vehicle antenna and a window glass for vehicle according to a first practical example.
Figure 3:
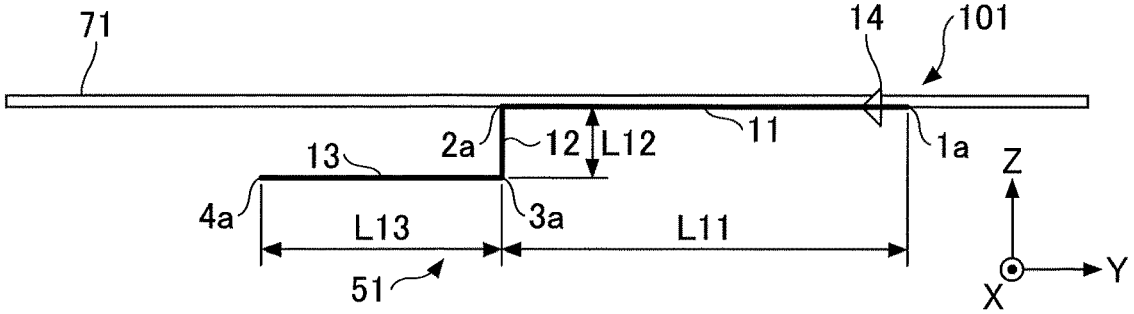
FIG. 3 is a side view schematically depicting the configuration of the vehicle antenna and the window glass for vehicle according to the first practical example.

FIG. 2 is a perspective view depicting a configuration of a vehicle antenna and a window glass for vehicle according to a first practical example, from a vehicle interior side viewpoint. FIG. 3 is a side view depicting the configuration of the vehicle antenna and the window glass for vehicle according to the first practical example. In FIGS. 2 and 3, an antenna 101 is an example of the antenna 100 illustrated in FIG. 1, and a window glass 71 is an example of the window glass 70 illustrated in FIG. 1.

The antenna 101 includes an element portion 51 having a shape of a crank and configured of an element 11, an element 12 and an element 13; and a feeding portion 14 for feeding power to the element portion 51. The element portion 51 is an example of the element portion 50 illustrated in FIG. 1, and the feeding portion 14 is an example of the feeding portion 40 illustrated in FIG. 1.

The element 11 is an example of the first element, and is a planar conductor extending in the up-down direction of the window glass 71. The element 11 has an upper end portion 1*a* and a lower end portion 2*a* in the up-down direction of the window glass 71. The upper end portion 1*a* is an example of the first upper end portion, and the lower end portion 2*a* is an example of the first lower end portion. The element 11 is brought into contact with the vehicle interior side surface of the window glass 71. Thus, the distance D1 is zero (0 mm).

The element 13 is an example of the second element, and is a planar conductor extending in the up-down direction of the window glass 71. The element 13 has an upper end portion 3*a* and a lower end portion 4*a* in the up-down direction of the window glass 71. The upper end portion 3*a* is an example of the second upper end portion, and the lower end portion 4*a* is an example of the second lower end portion.

A support member for supporting the antenna 101 may be arranged between the window glass 71 and at least one of the element 11 and the element 13. At least one of the element 11, the element 12, and the element 13 may be installed in a camera bracket mounted to the window glass 71.

The element 12 is an example of the third element, and is a planar conductor extending between the lower end portion 2*a* and the upper end portion 3*a*. An end of the element 12 is connected to the lower end portion 2*a*, and the other end of the element 12 is connected to the upper end portion 3*a*.

The element portion 51 includes a conductor portion 15, a conductor portion 16, and a loop slot 17. The conductor portion 15 is an example of a first conductor portion, and is formed so as to range over the element 11, the element 12 and the element 13. The conductor portion 16 is an example of a second conductor portion, and is formed inside the slot 17. That is, the conductor portion 16 is located inward in an in-plane direction with respect to the conductor portion 15 spaced by the slot 17. The conductor portion 16 is formed so as to range over the element 11, the element 12 and the element 13. The slot 17 is formed inside the conductor portion 15 so as to range over the element 11, the element 12 and the element 13. The element portion 51 includes the conductor portion 15; the slot 17 formed inside the conductor portion 15 so as to range over the element 11, the element 12 and the element 13; and the conductor portion 16 formed inside the slot 17, and thereby the bandwidth of the antenna 101 can be increased.

A shape of an inner contour of the conductor portion 15 and a shape of a contour of the conductor portion 16 are not particularly limited. The shapes may include a polygon including a quadrangle, a circle, a half circle, an ellipse, a fan-shape, and a shape including straight lines and curves. The shape of the inner contour of the conductor portion 15 and the shape of the contour of the conductor portion 16 may be a combination of the above-described shapes. However, the slot 17 formed by the conductor portion 15 and the conductor portion 16 preferably has a part in which a width gradually increases from the upper end portion of the element 11 toward the element 13. Thus, the bandwidth of the antenna 101 can be easily increased. The shape of the inner contour of the conductor portion 15 and the shape of the contour of the conductor portion 16 refer to shapes viewed on the elements in a planar shape obtained by unbending the bending portions of the elements.

In the example illustrated in FIG. 2, the shape of the inner contour of the conductor portion 15 is an ellipse on a bent plane, bent in a shape of a crank. That is, when the conductor portion 15 is unbent at the lower end portion 2*a* and the upper end portion 3*a*, the shape of the inner contour of the conductor portion 15 is an ellipse. The shape of the contour of the conductor portion 16 is an ellipse on a bent plane with a perimeter that is less than the perimeter of the inner contour of the conductor portion 15. The slot width of the slot 17 gradually increases from the upper end portion 1*a* of the element 11 toward the element 13. The feeding portion 14 is located at a position having a minimum slot width of the slot 17 (In FIG. 2, in an upper portion of the element 11 in the Y-axis direction). The feeding portion 14 is a dipole-type feeding portion. A core wire of a coaxial cable that is a feeding wire is connected to the upper portion of the conductor portion 16 and a ground wire of the coaxial cable is connected to the upper portion of the conductor portion 15, so as to interpose the slot 17. The ground wire of the coaxial cable may be connected to the upper portion of the conductor portion 16, and the core wire of the coaxial cable may be connected to the upper portion of the conductor portion 15. Moreover, when an AV line is used for the feeding wire, a connector for electrically connecting the AV line to the feeding portion 14 is mounted to the feeding portion 14, and thereby the AV line can be easily connected to the feeding portion 14. The letter "A" of the AV line represents low voltage cables for automobiles, and the letter "V" represents vinyl coating.

Figure 4:
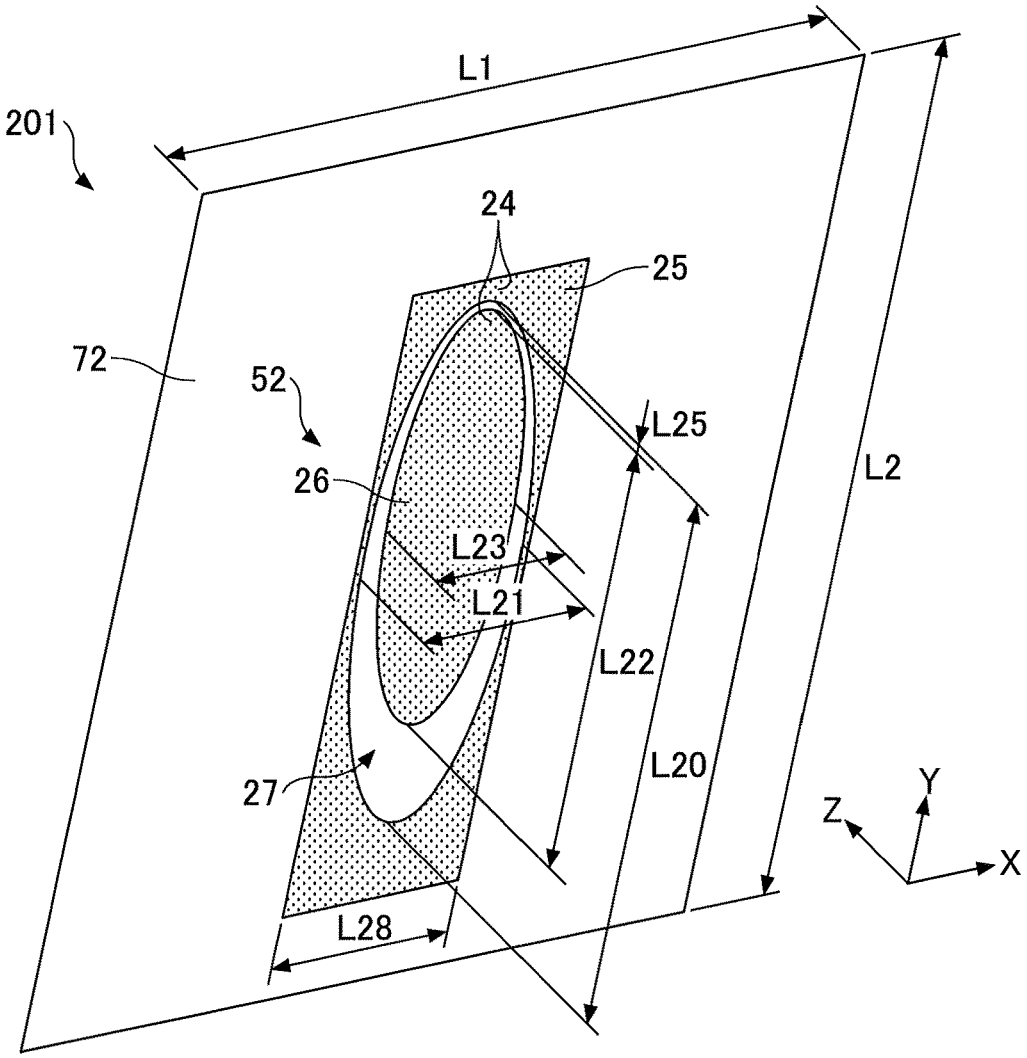
FIG. 4 is a perspective view schematically depicting a configuration of a vehicle antenna and a window glass for vehicle according to a first comparative example.
Figure 5:
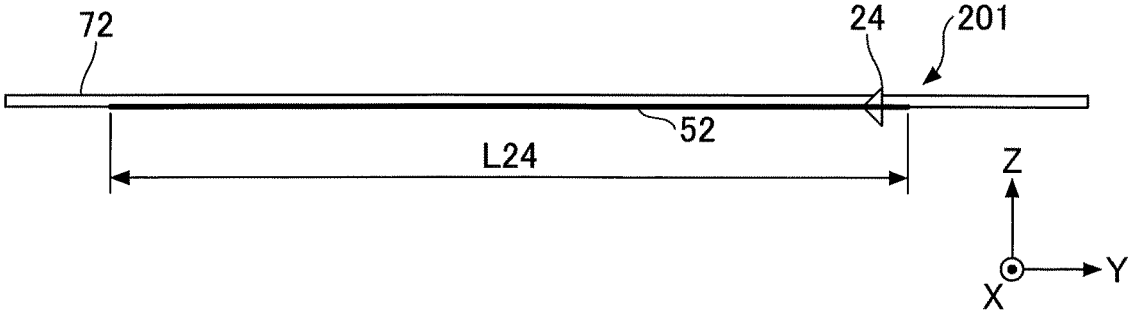
FIG. 5 is a side view schematically depicting the configuration of the vehicle antenna and the window glass for vehicle according to the first comparative example.

FIG. 4 is a perspective view depicting a configuration of a vehicle antenna and a window glass for vehicle according to a first comparative example, from a vehicle interior side viewpoint. FIG. 5 is a side view depicting the configuration of the vehicle antenna and the window glass for vehicle according to the first comparative example. An antenna 201 having an I-shape in a side view, as shown in FIGS. 4 and 5, is an example of an antenna that does not include an element portion having a shape of a crank. That is, the antenna 201 has a configuration in which the element portion 51 in the antenna 101, shown in FIGS. 2 and 3, is unbent. The antenna 201 is arranged on a window glass 72.

The antenna 201 includes an I-shaped element portion 52 configured of a conductor portion 25, a conductor portion 26, and a slot 27; and a feeding portion 24 for feeding power to the element portion 52. A shape of an inner contour of the conductor portion 25 is an ellipse. A shape of the conductor portion 26 is an ellipse with a perimeter that is less than the perimeter of the inner contour of the conductor portion 25. The feeding portion 24 is located at a position having a minimum slot width of the slot 27 (In FIG. 4, in the upper portion of the element portion 52 in the Y-axis direction). A core wire of a coaxial cable is connected to the upper portion of the conductor portion 26, and a ground wire of the coaxial cable is connected to the upper portion of the conductor portion 25.

Figure 6:
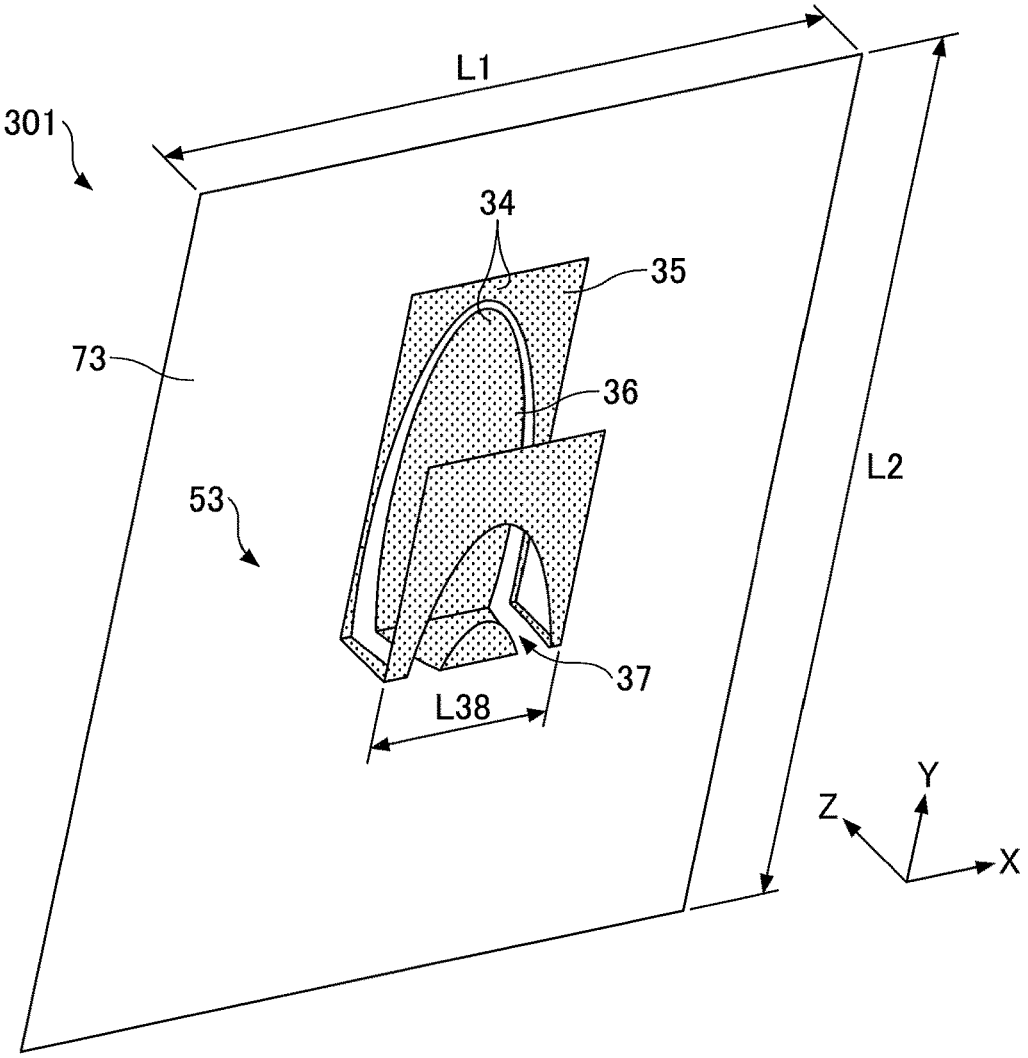
FIG. 6 is a perspective view schematically depicting a configuration of a vehicle antenna and a window glass for vehicle according to a second comparative example.
Figure 7:
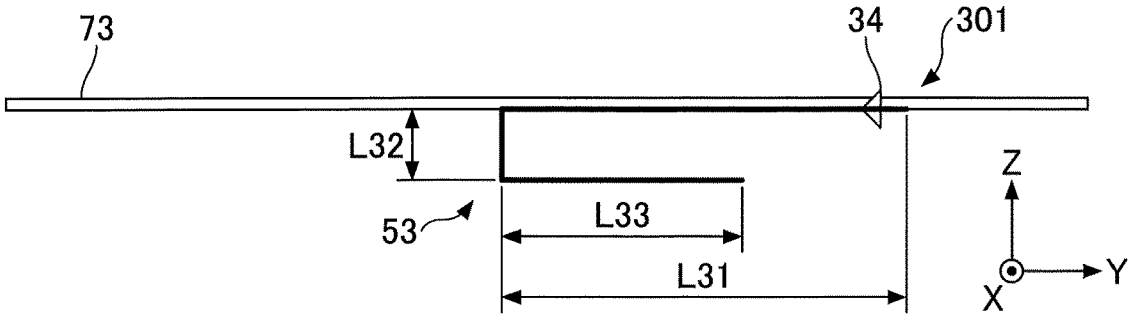
FIG. 7 is a side view schematically depicting the configuration of the vehicle antenna and the window glass for vehicle according to the second comparative example.

FIG. 6 is a perspective view depicting a configuration of a vehicle antenna and a window glass for vehicle according to a second comparative example, from a vehicle interior side viewpoint. FIG. 7 is a side view depicting the configuration of the vehicle antenna and the window glass for vehicle according to the second comparative example. An antenna 301 having a U-shape in a side view, as shown in FIGS. 6 and 7, is an example of an antenna that does not include an element portion having a shape of a crank. The antenna 301 is arranged on a window glass 73.

The antenna 301 includes a U-shaped element portion 53 formed by a conductor portion 35, a conductor portion 36, and a slot 37; and a feeding portion 34 for feeding power to the element portion 53. A shape of an inner contour of the conductor portion 35 is an ellipse on a bent plane, bent in a U-shape or in a J-shape. A shape of a contour of the conductor portion 36 is an ellipse on a bent plane, bent in a U-shape or in a J-shape, with a perimeter that is less than the perimeter of the inner contour of the conductor portion 35. The feeding portion 34 is located at a position having a minimum slot width of the slot 37 (In FIG. 6, in an upper portion of the element portion 53 in the Y-axis direction). A core wire of a coaxial cable is connected to an upper portion of the conductor portion 36, and a ground wire of the coaxial cable is connected to the upper portion of the conductor portion 35.

The lower portion of the antenna 301 (that is to say, the portion including a widest width portion of the slot 37) is different from the element 13 of the antenna 101, shown in FIGS. 2 and 3. The lower portion of the antenna 301 (including the widest width portion of the slot 37) extends parallel to the window glass 73 in a direction from a lower side toward an upper side of the window glass 73, and faces the upper portion of the antenna 301 (including a narrow width portion of the slot 37).

Figure 8:
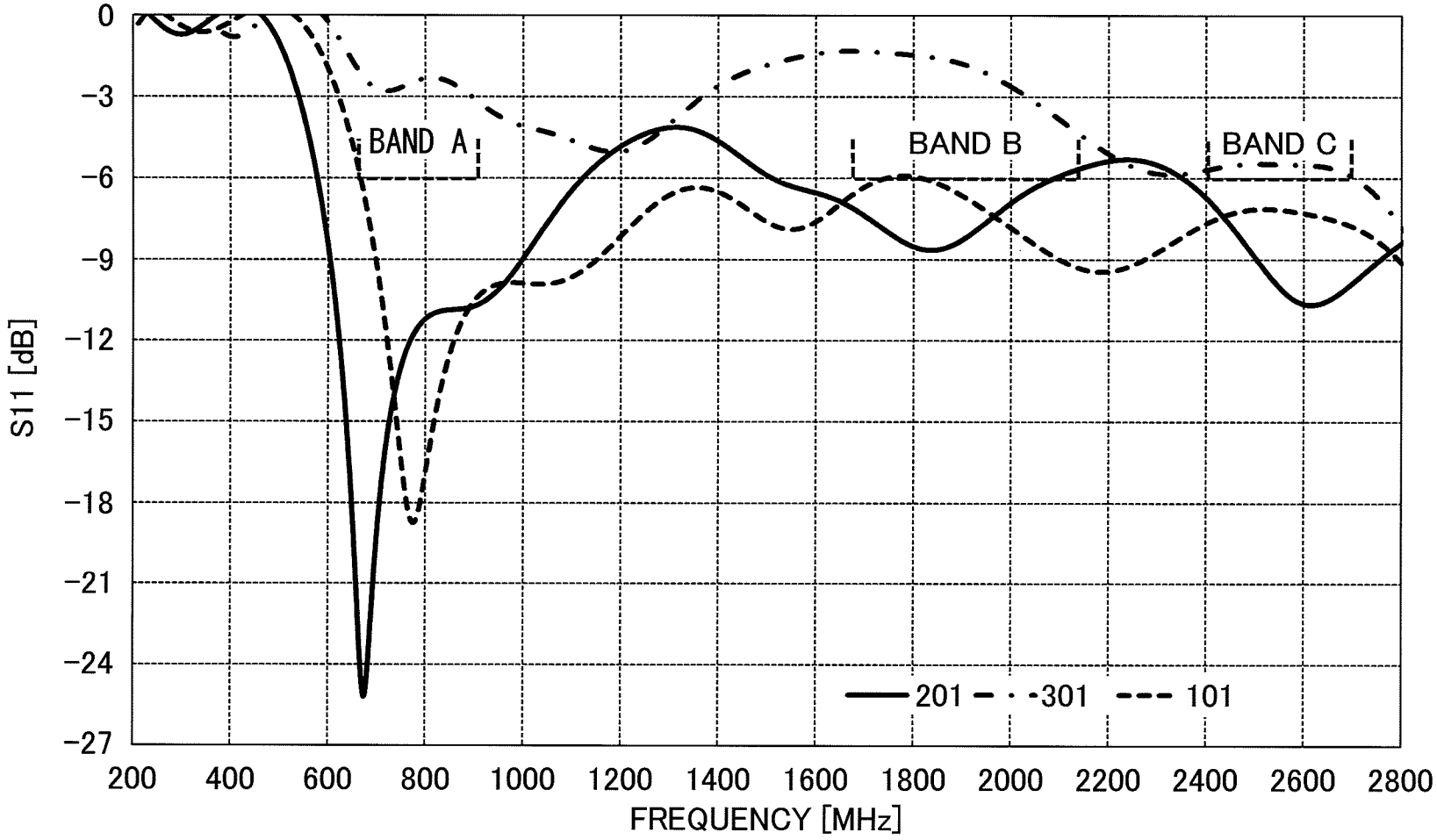
FIG. 8 is a diagram depicting an example of return loss characteristics of the vehicle antenna according to the first practical example.

FIG. 8 is a diagram depicting an example of a result of simulation for return loss characteristics of the vehicle antennas 101, 201, and 301 according to the first practical example. For the simulations for electromagnetic fields, Microwave Studio (trademark registered) by CST—Computer Simulation Technology AG was used. In FIG. 8, "Band A" indicates the frequency band for LTE (0.698 GHz to 0.96 GHz), "Band B" indicates the frequency band for LTE (1.71 GHz to 2.17 GHz), and "Band C" indicates the frequency band for LTE (2.4 GHz to 2.69 GHz). The vertical axis indicates a reflection coefficient S11 for each of the antennas.

It is found that in any of the Bands A, B and C for the U-shaped antenna 301, an excellent impedance matching was not obtained. However, it is found that in each of the Bands A, B and C (especially Band A) for the antenna 101 having the shape of a crank and the I-shaped antenna 201, an excellent impedance matching was obtained.

Figure 9:
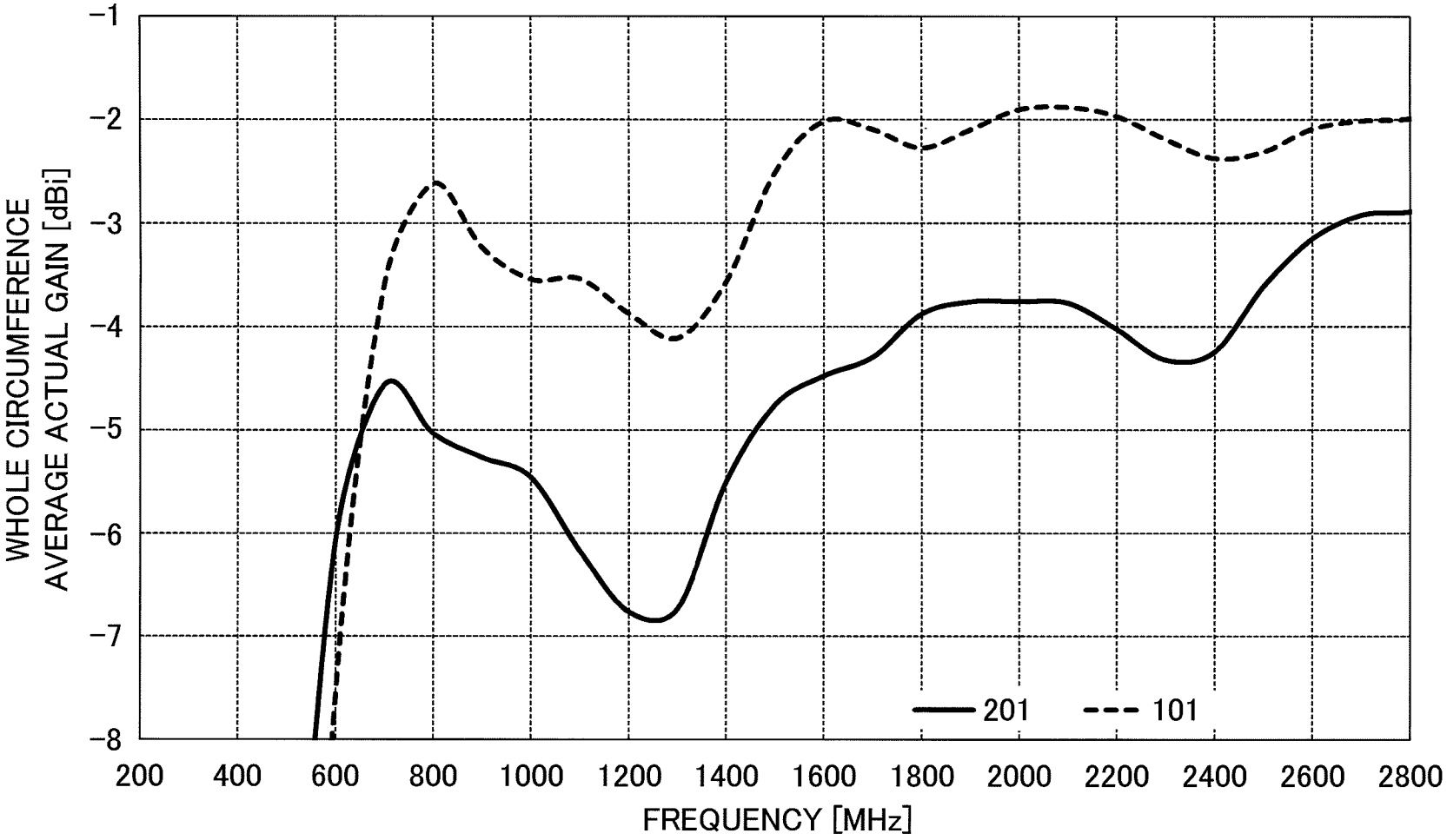
FIG. 9 is a diagram depicting an example of actual gains of the vehicle antenna according to the first practical example.

FIG. 9 is a diagram depicting an example of actual gains of the respective antennas 101 and 201, according to the first practical example. In FIG. 9, the vertical axis indicates an average value of antenna gains (actual gains) obtained by averaging 0° to 360° of azimuthal angles of the direction of the antenna, which is parallel to the horizontal plane. As shown in FIG. 9, it is found that the antenna gain in the horizontal direction of the antenna having a shape of a crank 101 is superior to the antenna gain in the horizontal direction of the I-shaped antenna 201.

In the simulations of the reflection coefficient and the antenna gain, as shown in FIGS. 8 and 9, dimensions of the respective members of the antenna, illustrated in FIGS. 2 to 7, are as follows (in units of mm), L1: 150,
L2: 200,
L11: 80,
L12: 15,
L13: 50,
L18: 40,
L20: 120 (long diameter of ellipse of outer conductor),
L21: 38 (short diameter of ellipse of outer conductor),
L22: 96 (long diameter of ellipse of inner conductor),
L23: 30 (short diameter of ellipse of inner conductor),
L24: 145,
L25: 1 (narrowest portion of slot (feeding point)),
L28: 40,
L31: 80,
L32: 15,
L33: 50, and
L38: 40.

Moreover, the angles θ, α and β (See FIG. 1) are 30°, 90°, and 90°, respectively. The dimensions of the respective members of the element portion 51 having a shape of a crank, shown in FIG. 2, in the state where the element portion 51 is unbent, and the dimensions of the respective members of the U-shaped element portion 53, shown in FIG. 6, in the state where the element portion 53 is unbent, are the same as the dimensions of the corresponding members of the I-shaped element portion 52, shown in FIG. 4, respectively.

Second Practical Example

Figure 10:
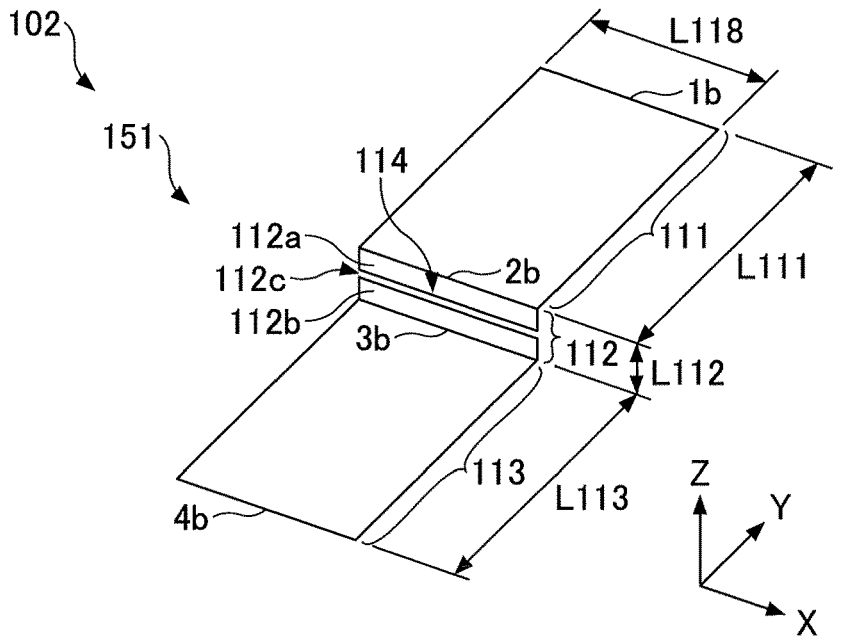
FIG. 10 is a perspective view schematically depicting a configuration of a vehicle antenna according to a second practical example.

FIG. 10 is a perspective view depicting a configuration of a vehicle antenna according to a second practical example. An antenna 102 is an example of the antenna 100, illustrated in FIG. 1. The antenna 102 is a dipole antenna in which a feeding portion 114 is arranged on an element 112. In FIG. 10, a window glass is not illustrated, but the antenna 102 is mounted to the window glass in the same attaching form as that shown in FIGS. 2 and 3.

The vehicle antenna according to the second practical example is not limited to the dipole antenna having the shape illustrated in FIG. 10. For example, the vehicle antenna may be a dipole antenna in which shapes of two elements on both sides of the feeding portion 114, in the state where the lower end portion 2*b* and the upper end portion 3*b* are unbent, are ellipses. Moreover, the vehicle antenna may be a dipole antenna in which shapes of two elements on both sides of the feeding portion 114, in the state where the lower end portion 2*b* and the upper end portion 3*b* are unbent, are triangles, i.e. a bow tie antenna. Furthermore, the vehicle antenna may be a folded dipole antenna having a loop shape with the feeding portion 114 as a starting point in the state where the lower end portion 2*b* and the upper end portion 3*b* are unbent.

The antenna 102 includes an element portion 151 having a shape of a crank and configured of an element 111, an element 112 and an element 113; and a feeding portion 114 for feeding power to the element portion 151. The element portion 151 is an element of the element portion 50 illustrated in FIG. 1, and the feeding portion 114 is an example of the feeding portion 40 illustrated in FIG. 1.

The element 111 is an example of the first element, and is a planar conductor extending in the up-down direction of the window glass. The element 111 has an upper end portion 1*b* and a lower end portion 2*b* in the up-down direction of the window glass. The upper end portion 1*b* is an example of the first upper end portion, and the lower end portion 2*b* is an example of the first lower end portion.

The element 113 is an example of the second element, and is a planar conductor extending in the up-down direction of the window glass. The element 113 has an upper end portion 3*b* and a lower end portion 4*b* in the up-down direction of the window glass. The upper end portion 3*b* is an example of the second upper end portion, and the lower end portion 4*b* is an example of the second lower end portion.

The element 112 is an example of the third element, and is a planar conductor extending between the lower end portion 2*b* and the upper end portion 3*b*. An end of the element 112 is connected to the lower end portion 2*b*, and the other end of the element 112 is connected to the upper end portion 3*b*.

The element 112 is separated by a gap 112*c* into a first partial element 112*a* and a second partial element 112*b*. The feeding portion 114 is a dipolar feeding portion. A core wire of a coaxial cable is connected to the partial element 112*a* and a ground wire of the coaxial cable is connected to the partial element 112*b* so as to interpose the gap 112*c*. Alternatively, the ground wire of the coaxial cable is connected to the partial element 112*a* and the core wire of the coaxial cable is connected to the partial element 112*b*.

Figure 11:
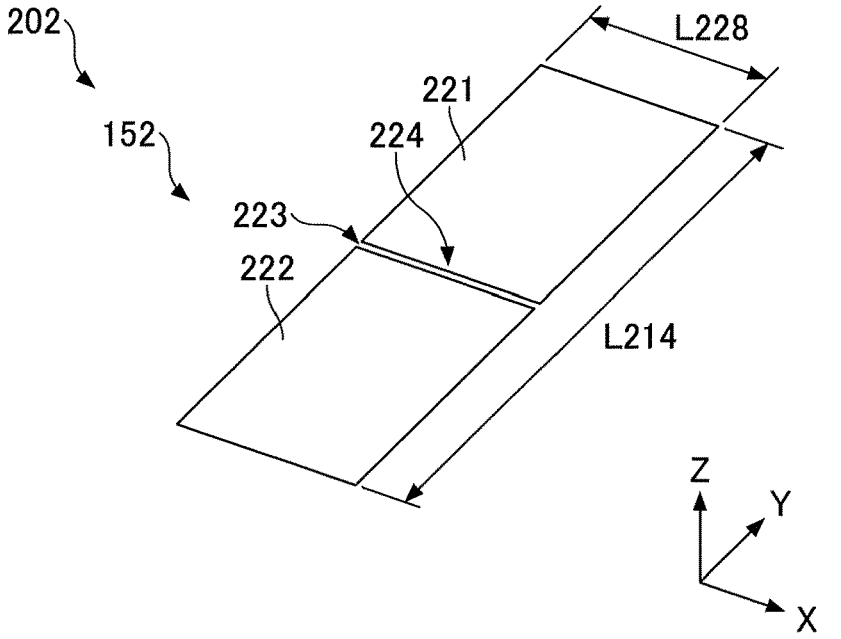
FIG. 11 is a perspective view schematically depicting a configuration of a vehicle antenna according to a third comparative example.

FIG. 11 is a perspective view depicting a configuration of a vehicle antenna according to a third comparative example.

An I-shaped antenna 202, shown in FIG. 11, is an example of an antenna that does not include an element portion having a shape of a crank. The antenna 202 is a dipole antenna in which the feeding portion 224 is arranged at the gap 223. That is, the antenna 202 has a configuration in which the element portion 151 in the antenna 102, shown in FIG. 10, is unbent. In FIG. 11, a window glass is not illustrated, but the antenna 202 is mounted to the window glass in the same attaching form as that in FIGS. 4 and 5.

The antenna 202 includes an I-shaped element portion 152 configured of a planar conductor portion 221, a planar conductor portion 222, and a gap 223; and a feeding portion 224 for feeding power to the element portion 152. A core wire of a coaxial cable is connected to a lower part of the conductor portion 221, and a ground wire of the coaxial cable is connected to an upper part of the conductor portion 222.

Figure 12:
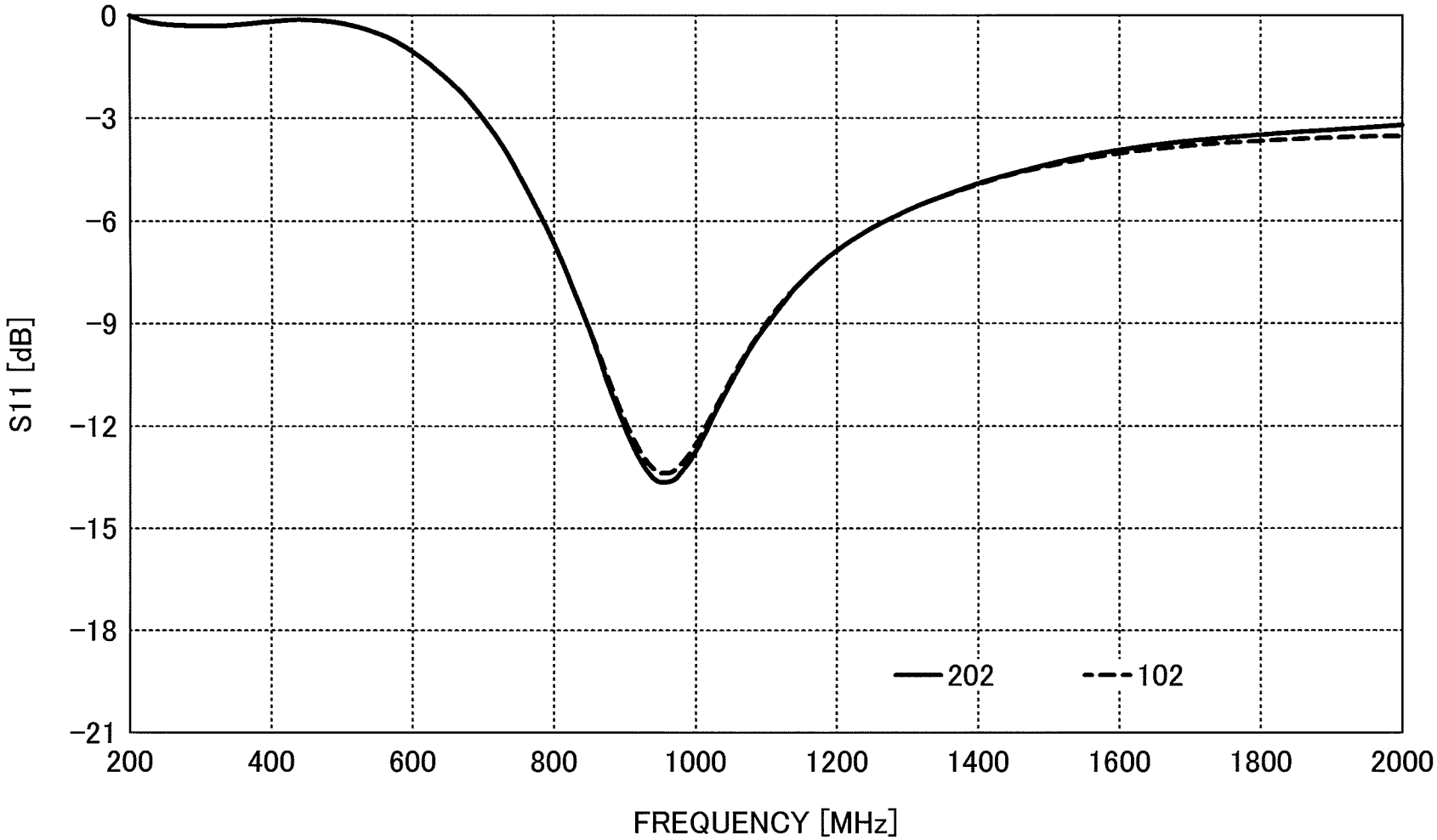
FIG. 12 is a diagram depicting an example of return loss characteristics of the vehicle antenna according to the second practical example.

FIG. 12 is a diagram depicting an example of a result of measurement for return loss characteristics of the vehicle antenna 102 and 202 according to the second practical example. The vertical axis indicates a reflection coefficient S11 for each of the antennas.

From the result of the measurement, shown in FIG. 12, it is found that an excellent impedance matching was obtained for both the antenna having a shape of a crank 102 and the I-shaped antenna 202 in the frequency band around 900 MHz.

Figure 13:
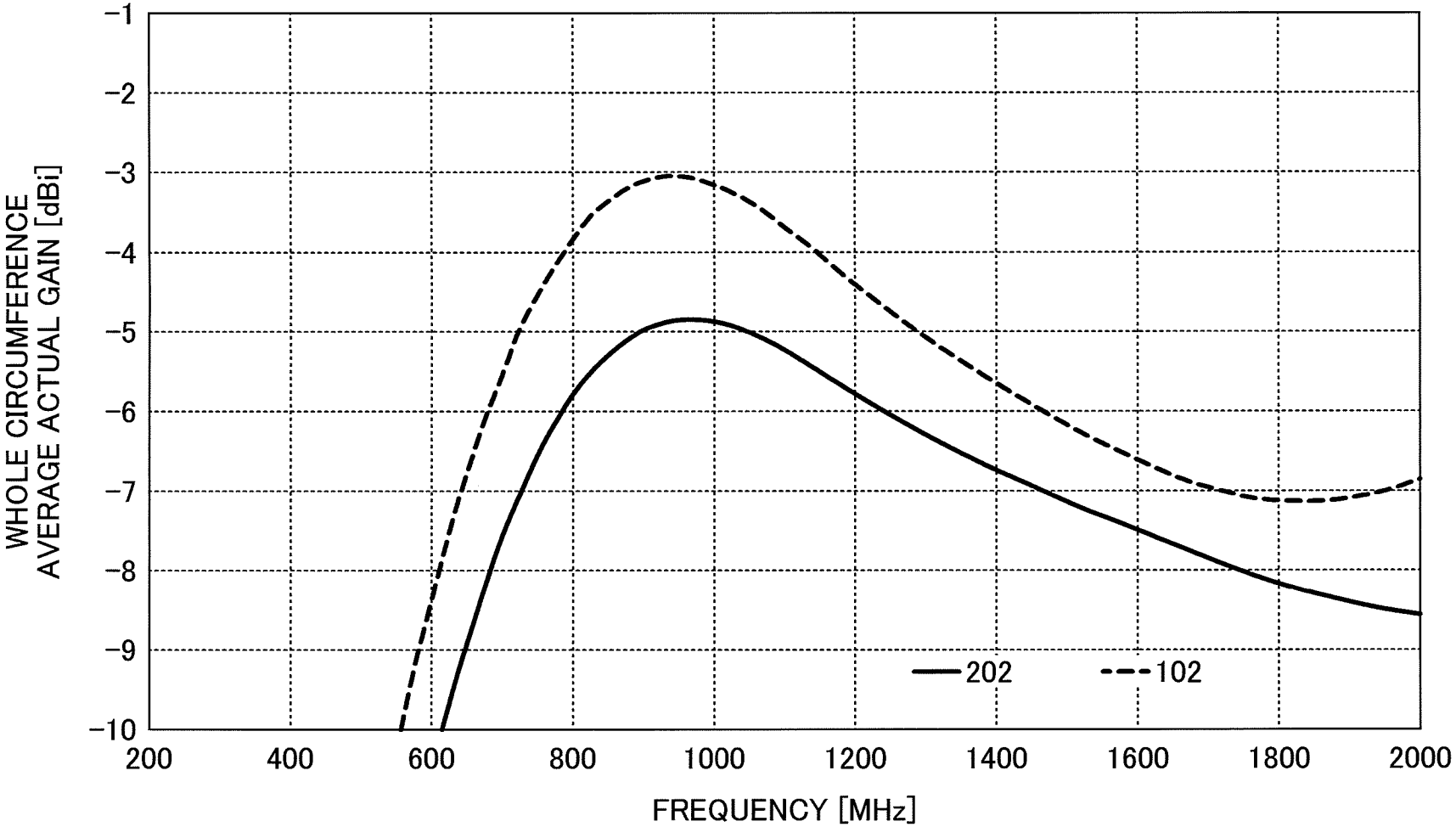
FIG. 13 is a diagram depicting an example of actual gains of the vehicle antenna according to the second practical example.

FIG. 13 is a diagram depicting an example of actual gains of the vehicle antenna 102 and 202, according to the second practical example. In FIG. 13, the vertical axis indicates an average value of antenna gains (actual gains) obtained by averaging 0° to 360° of azimuthal angles of the direction of the antenna, which is parallel to the horizontal plane. As shown in FIG. 13, it is found that the antenna gain in the horizontal direction of the antenna having a shape of a crank 102 is superior to the antenna gain in the horizontal direction of the I-shaped antenna 202.

In the simulations of the reflection coefficient and the antenna gain, as shown in FIGS. 12 and 13, dimensions of the respective members of the antenna, illustrated in FIGS. 12 and 13, are as follows (in units of mm), L111: 70,
L112: 12,
L113: 70,
L118: 40,
L214: 140, and
L228: 40.

Moreover, the angles θ, α and β (See FIG. 1) are 30°, 90°, and 90°, respectively. Gap lengths of the gaps 112*c* and 223 were 0.5 mm.

As described above, the vehicle antenna and a window glass for vehicle have been described by the embodiments. The present invention is not limited to the embodiments. Various variations and enhancements, such as combination/replacement with/by a part or whole of another embodiment may be made without departing from the scope of the present invention.

REFERENCE SIGNS LIST

1 upper end portion
2 lower end portion
10, 11, 111 first element
15 first conductor portion
16 second conductor portion
17 slot
20, 12, 112 third element
30, 13, 113 second element
14, 24, 34, 40, 114, 224 feeding portion
50, 51, 52, 53, 151, 152 element portion
60 horizontal plane
70, 71, 72, 73 window glass
80 vehicle
100, 101, 102, 201, 202, 301 antenna

What is claimed is:

1. A vehicle antenna arranged on a window glass for a vehicle, the vehicle antenna comprising:
a conductive element having a shape of a crank handle and being formed by a first element, a second element and a third element, wherein the conductive element includes
a first conductor portion; and
a second conductor portion located inward in an in-plane direction with respect to the first conductor portion spaced by a slot,
the slot being formed so as to range over the first element, the second element and the third element; and
a feeding portion configured to feed power to the conductive element,
the first element having a first upper end portion and a first lower end portion, and extending in an up-down direction of the window glass, wherein the feeding portion is located at the first upper end portion,
the second element having a second upper end portion and a second lower end portion, and extending in the up-down direction of the window glass,
the third element extending between the first lower end portion and the second upper end portion, and
a first distance between the first lower end portion and the window glass being different from a second distance between the second upper end portion and the window glass.

2. The vehicle antenna according to claim 1,
wherein the first distance is less than the second distance.

3. The vehicle antenna according to claim 1,
wherein a long-side direction of the conductive element is parallel to the up-down direction of the window glass.

4. The vehicle antenna according to claim 1,
wherein the slot includes a part in which a width increases along a direction from the first upper end portion toward the second element.

5. The vehicle antenna according to claim 1,
wherein a shape of an inner contour of the first conductor portion is an ellipse, and
wherein a shape of a contour of the second conductor portion is an ellipse.

6. The vehicle antenna according to claim 1,
wherein the feeding portion is located on the third element.

7. The vehicle antenna according to claim 6,
wherein the third element is separated by a gap into a first partial element and a second partial element.

8. The window glass for the vehicle provided with the vehicle antenna according to claim 1.

9. The vehicle antenna according to claim 1, wherein the first element and the second element are configured to extend parallel to a vehicle interior side surface of the window glass by extending in the up-down direction of the window glass.

10. A vehicle antenna arranged on a window glass for a vehicle, the vehicle antenna comprising:
a conductive element having a shape of a crank handle and being formed by a first element, a second element and a third element; and a feeding portion configured to feed power to the conductive element, the first element having a first upper end portion and a first lower end portion, and extending in an up-down direction of the window glass, the second element having a second upper end portion and a second lower end portion, and extending in the up-down direction of the window glass, the third element extending between the first lower end portion and the second upper end portion, and a first distance between the first lower end portion and the window glass being different from a second distance between the second upper end portion and the window glass, wherein a length of a component in a direction normal to a surface of the window glass of the third element falls within a range from 0.013λ, to 0.096λ, λ being a wavelength of electromagnetic waves at an operation frequency of the vehicle antenna.

11. The vehicle antenna according to claim 10, wherein the first distance is less than the second distance.

12. The vehicle antenna according to claim 10, wherein a long-side direction of the conductive element is parallel to the up-down direction of the window glass.

13. The vehicle antenna according to claim 10, wherein the feeding portion is located at the first upper end portion.

14. The vehicle antenna according to claim 13, wherein the conductive element includes a first conductor portion; and a second conductor portion located inward in an in-plane direction with respect to the first conductor portion spaced by a slot, the slot being formed so as to range over the first element, the second element and the third element.

15. The vehicle antenna according to claim 14, wherein the slot includes a part in which a width increases along a direction from the first upper end portion toward the second element.

16. The vehicle antenna according to claim 14, wherein a shape of an inner contour of the first conductor portion is an ellipse, and wherein a shape of a contour of the second conductor portion is an ellipse.

17. The vehicle antenna according to claim 10, wherein the feeding portion is located on the third element.

18. The vehicle antenna according to claim 17, wherein the third element is separated by a gap into a first partial element and a second partial element.

19. The window glass for the vehicle provided with the vehicle antenna according to claim 10.

20. The vehicle antenna according to claim 10, wherein the first element and the second element are configured to extend parallel to a vehicle interior side surface of the window glass by extending in the up-down direction of the window glass.

* * * * *